US006085534A

United States Patent [19]

Anthony

[11] Patent Number: 6,085,534

[45] Date of Patent: Jul. 11, 2000

[54] NON-ELECTRIC REFRIGERATING VENDING MACHINE

[76] Inventor: Michael M. Anthony, 6113 NW. 66th Way, Parkland, Fla. 33067

[21] Appl. No.: 09/272,785

[22] Filed: Mar. 19, 1999

[51] Int. Cl.[7] ..... F25B 19/00

[52] U.S. Cl. ..... 62/231; 62/374; 221/150 R

[58] Field of Search ..... 62/64, 373, 374, 62/378, 231; 221/150 R; 222/146.6

[56] References Cited

U.S. PATENT DOCUMENTS

| | | | |
|---|---|---|---|
| 4,920,764 | 5/1990 | Martin | 62/259.1 |
| 5,331,817 | 7/1994 | Anthony | 62/5 |
| 5,671,604 | 9/1997 | Rudick | 62/52.1 |

*Primary Examiner*—Henry Bennett
*Assistant Examiner*—Marc Norman
*Attorney, Agent, or Firm*—Oltman, Flynn & Kubler

[57] ABSTRACT

A vending machine structured to store a plurality of items to be vended at room temperature and to selectively dispense individual chilled items as selected by a purchaser, without the use of electric power. The machine comprises a main housing having a retrieval tray integrally formed within the outer surface, and an insulated internal surface, a tank filled with a pressurized gas capable of being emitted as a gas or a refrigerant liquid, a generally downwardly sloping storage tray, a downwardly sloping track having a first upper end coupled to a sidewall of the storage tray and a second lower end coupled to a cooling chamber, and a control valve structured to control the sequence of operation of the machine. Pneumatic pistons are coupled to the control valve and mounted to the storage tray, the top of the cooling chamber and the sidewall of the cooling chamber so that upon activation of the control valve, a select item to be vended is transported to the cooling chamber and enclosed therein, cooling liquid is applied to the select item for a predetermined length of time, and then the select item is transported from the cooling chamber to the retrieval tray.

20 Claims, 11 Drawing Sheets

NON-ELECTRIC REFRIGERATING VENDING MACHINE

BACKGROUND OF THE INVENTION

1. Field of the Invention

The present invention relates to vending machines and, more particularly, to non-electric vending machine utilizing liquified and pressurized gas to power the machine and refrigerate the vended items.

2. Description of the Related Art

In today's world of convenience and around the clock access, vending machines have become a vital resource to consumers. As such, the demand arose for vending machines to carry a wide variety of food, beverage and other temperature sensitive items. As a result refrigerated vending machines, such as those disclosed and referenced in U.S. Pat. No. 4,920,764, were developed.

Although each of these prior art refrigerated vending machines may include somewhat different features which distinguish them from one another, they are all based on the same underlying refrigeration concept. That is, they all refrigerate the entire internal portion of the machine or the internal compartment wherein the temperature sensitive items are stored.

Although useful for their intended purpose, the prior art refrigerated vending machines include certain inherent limitations. Specifically, to maintain a portion of the machine refrigerated at all times, the machine must include certain refrigeration components and the internal refrigerated portion must be properly sealed. Such components and sealing increase the cost of the machine. Moreover, the refrigeration components require a constant power source to maintain the refrigerated portion at the desired temperature, thereby increasing the recurring cost required to operate the machine. Additionally, in the event electrical power to the machine is lost, the refrigeration components, as well as all other electrical components including the electrically powered dispensing components, will cease operating, resulting in the loss of refrigeration and the inability to dispense chilled, or non-chilled, items.

Accordingly, there is still a need in the art for a vending machine having non-electric means of refrigerating select items to be dispensed. Any such device should further include non-electric means for powering the internal operating components of the machine. The present invention is particularly suited to overcome those problems which remain in the art in a manner not previously known.

SUMMARY OF THE INVENTION

The present invention is directed towards a new and improved vending machine structured to store a plurality of items to be vended at room temperature and to selectively dispense individual chilled items as selected by a purchaser, without the use of electric power. The machine comprises a main housing having a retrieval tray integrally formed within the outer surface and at least one receptacle structured to receive currency, a tank filled with a pressurized liquified refrigerant with a gaseous phase capable of being emitted as a gas or a refrigerant liquid, a generally downwardly sloping storage tray, a downwardly sloping track having a first upper end coupled to a sidewall of the storage tray and a second lower end coupled to a cooling chamber, and a control valve structured to control the sequence of operation of the machine. Pneumatic pistons are coupled to the control valve and mounted to the storage tray, the top of the cooling chamber and the sidewall of the cooling chamber so that upon activation of the control valve, the following sequence of operation is initiated:

1. gas from the tank is sent to the first piston causing the first piston to project through the sidewall of the storage tray and push the select item to be vended onto the track and slide down the track into the cooling chamber;
2. gas from the tank is sent to the second piston causing the second piston to lower the cooling chamber top, thereby enclosing the select item to be vended therein;
3. gas from the tank is sent to a second timing valve, which is coupled to the liquid port of the tank, causing liquified refrigerant to be dispensed to the cooling chamber for a predetermined length of time, and causing heat to be removed from the vended item by the evaporation of the liquified refrigerant;
4. gas from the tank is sent to the third piston causing the third piston to project through the sidewall of the cooling chamber, thereby pushing the select item to be vended out of the cooling chamber and into the retrieval tray, where it may be retrieved by the purchaser.

It is an object of the present invention to provide a new and improved vending machine which has all the advantages of the prior art devices and none of the disadvantages.

It is a further object of the present invention to provide a vending machine capable of operating without electric power.

It is another object of the present invention to provide a vending machine having non-electric means of refrigerating select items to be dispensed.

It is yet another object of the present invention to provide such a machine which includes non-electric means for powering the internal operating components of the machine.

It is also an object of the present invention to provide such a machine which utilizes the gaseous phase and liquid phase of the pressurized gas as the means for powering the machine and the refrigeration means, respectively.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Figure 1:
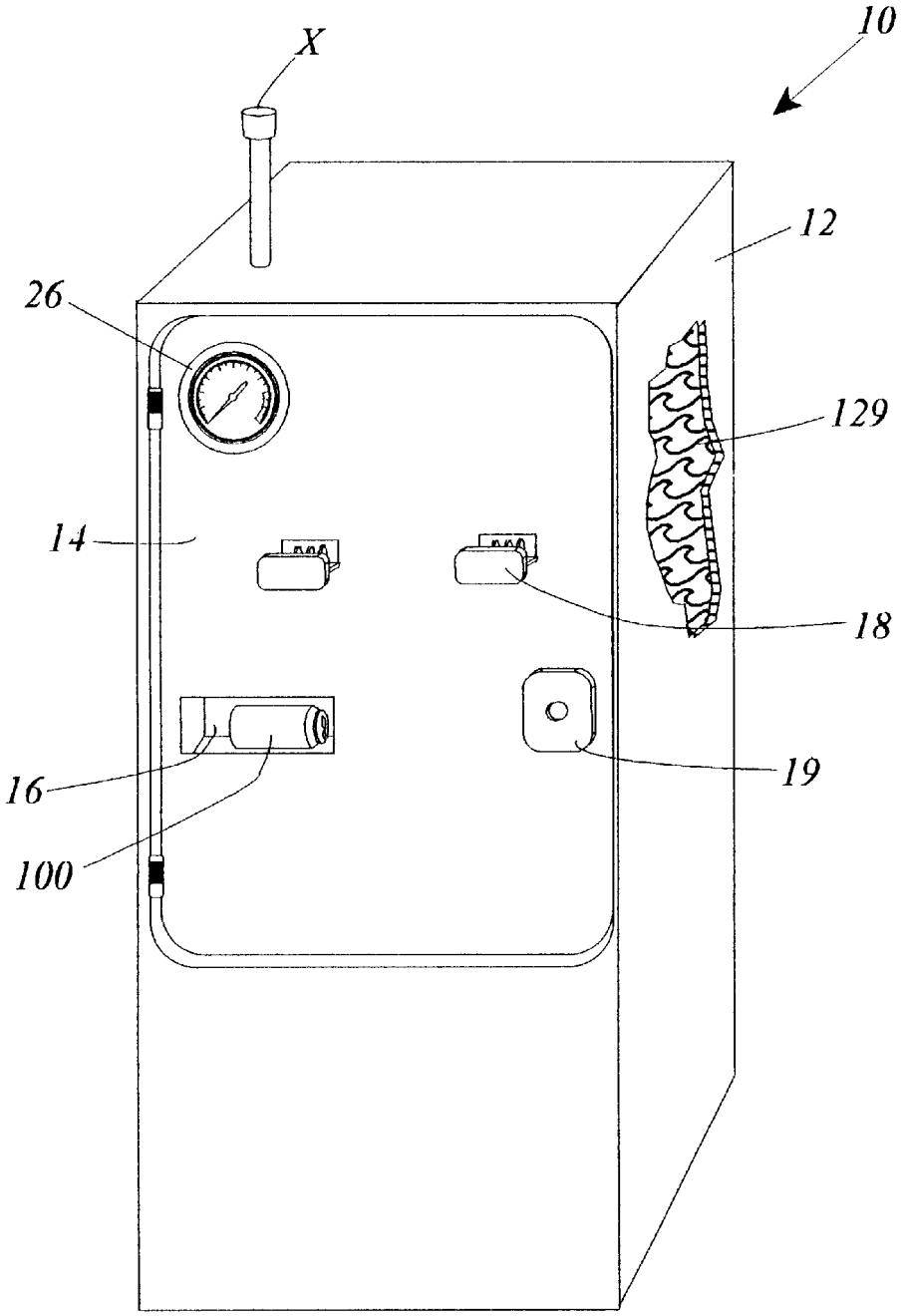
FIG. 1 is a perspective view of the non-electric vending machine of the present invention.
Figure 2:
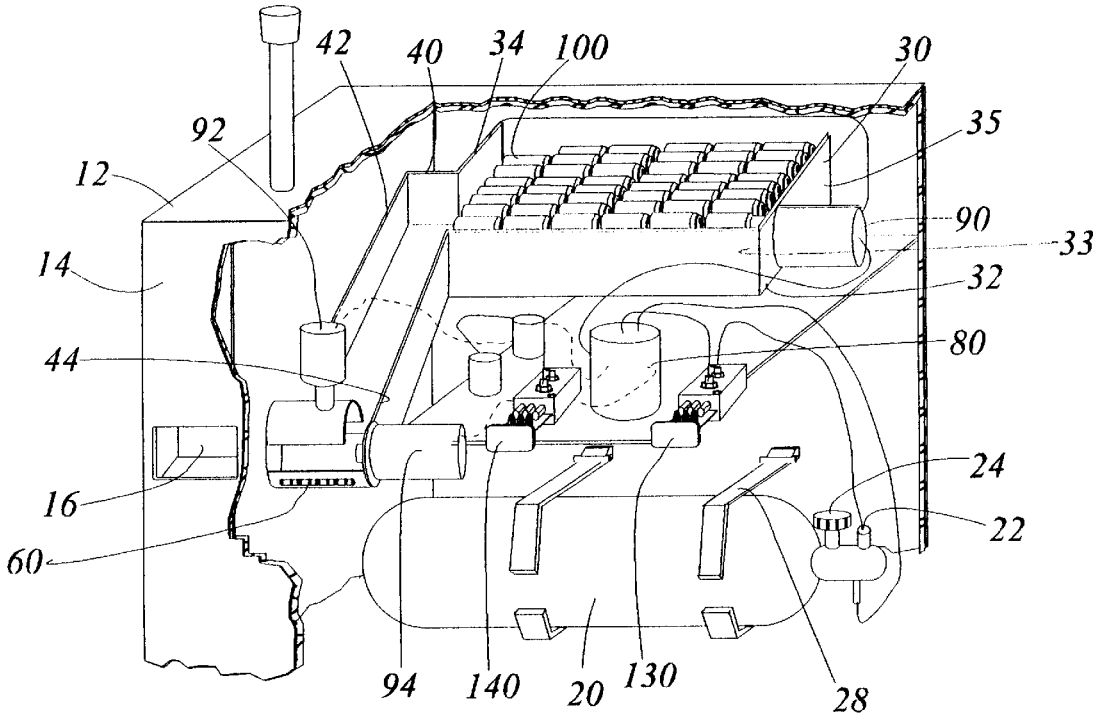
FIG. 2 is a perspective view of the non-electric vending machine of the present invention, in partial section, showing the internal configuration with the items to be vended in the stored position.
Figure 3:
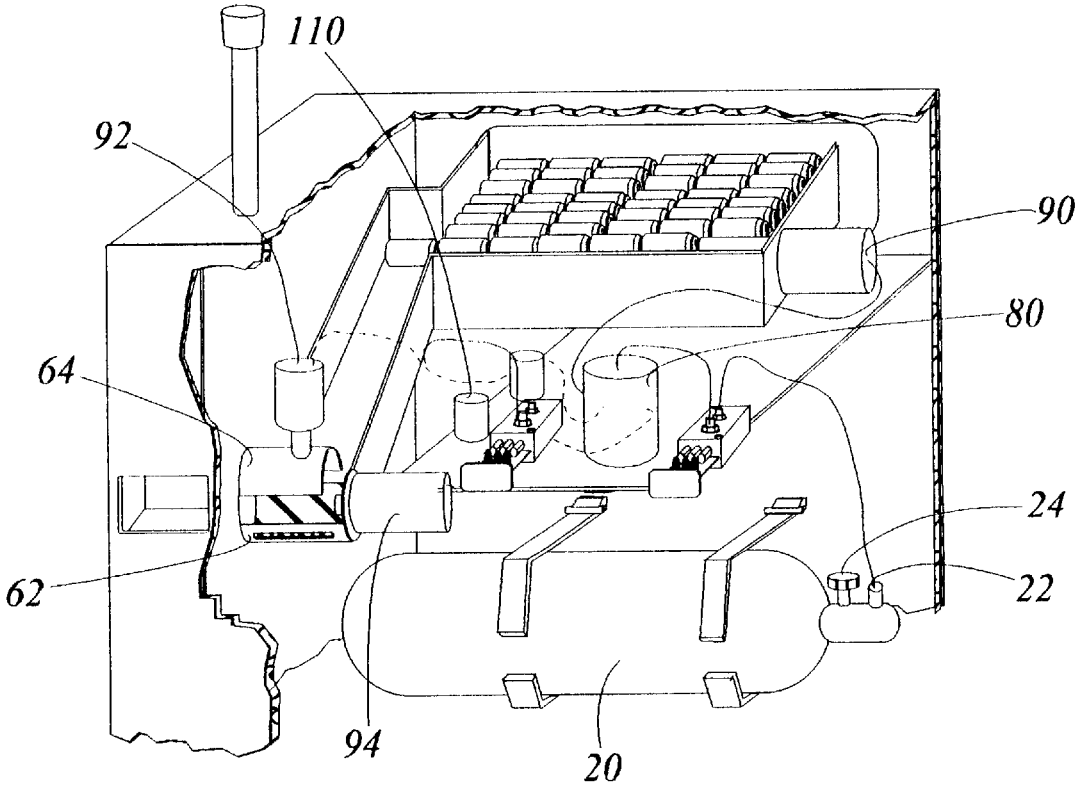
FIG. 3 is a perspective view of the non-electric vending machine of the present invention, in partial section, showing the internal configuration with the item to be vended at the top of the dispensing track.
Figure 4:
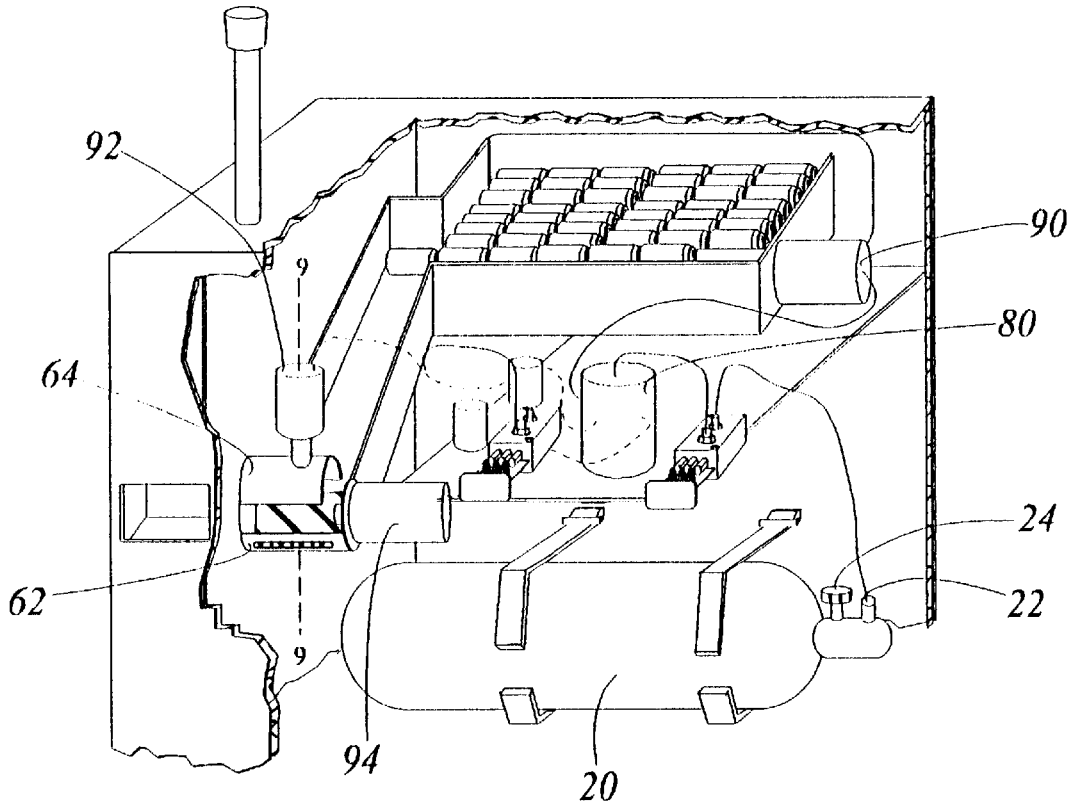
FIG. 4 is a perspective view of the non-electric vending machine of the present invention, in partial section, showing the internal configuration with the item to be vended enclosed within the cooling chamber.
Figure 5:
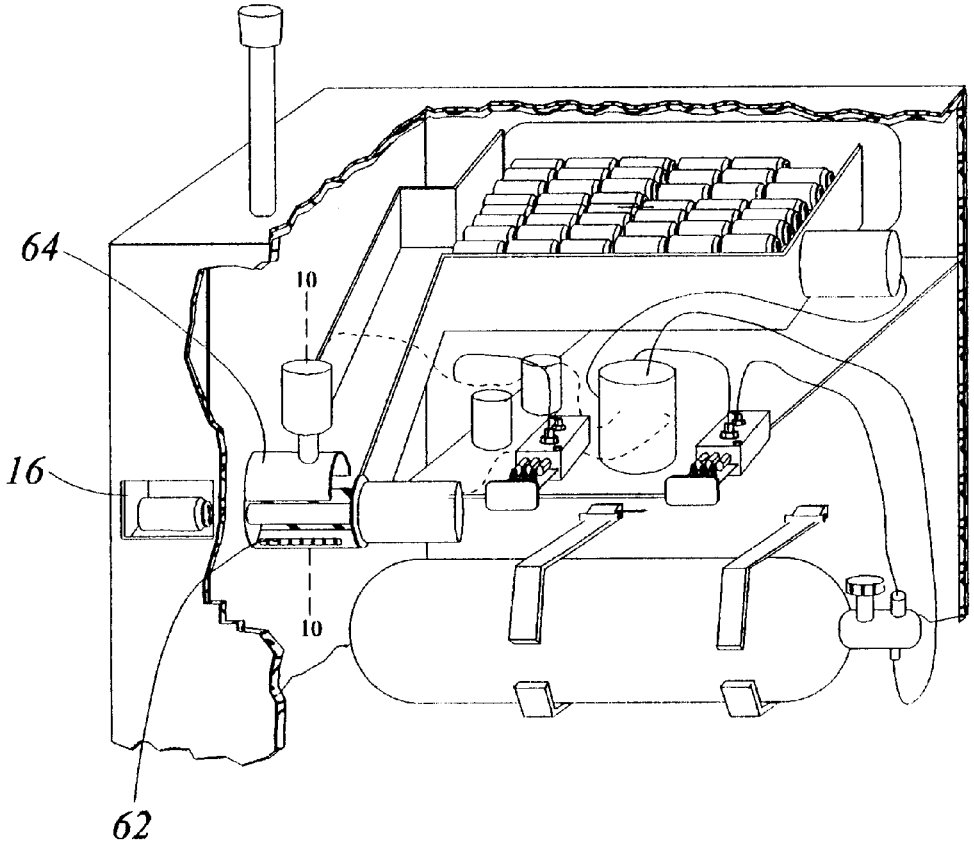
FIG. 5 is a perspective view of the non-electric vending machine of the present invention, in partial section, showing the internal configuration with the item to be vended in the retrieval tray.
Figure 6:
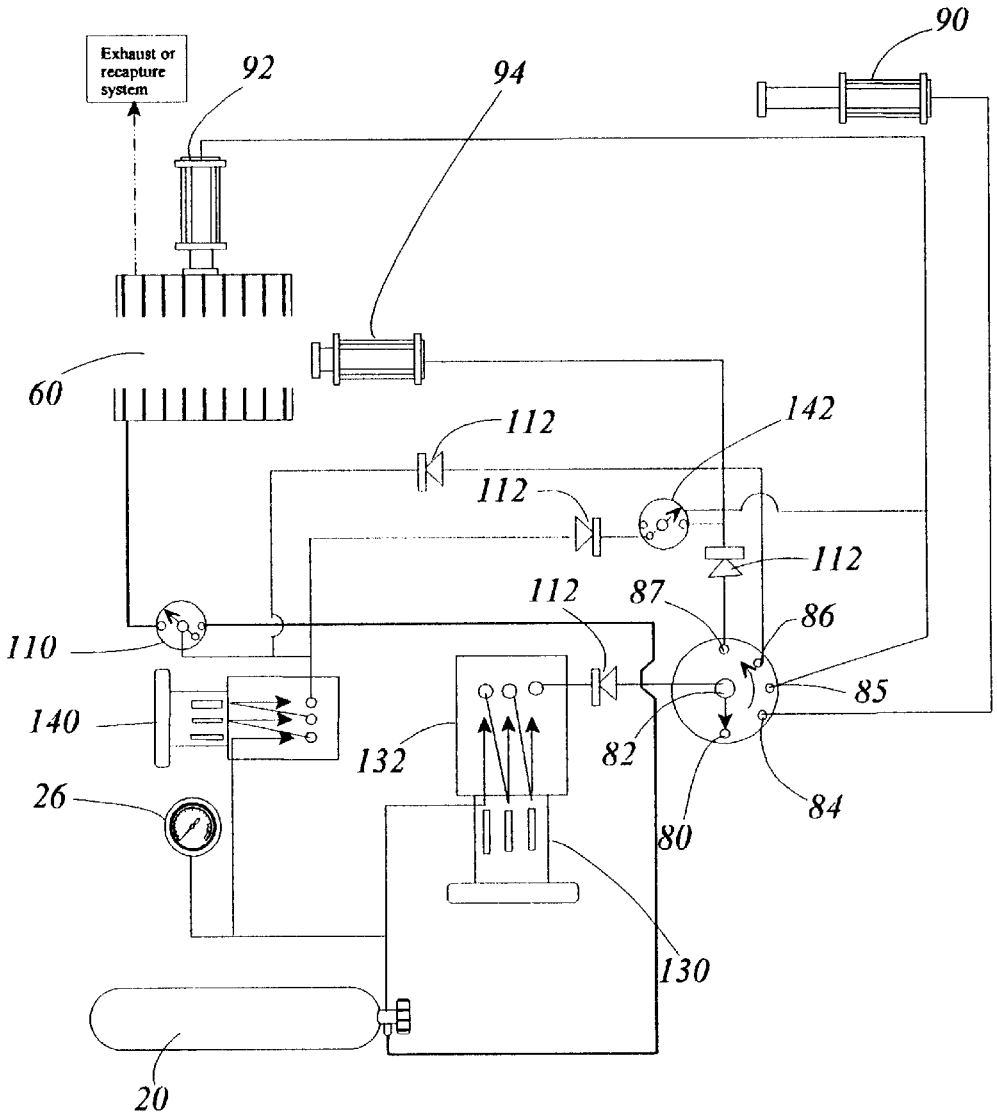
FIG. 6 is a schematic diagram of the non-electric vending machine of the present invention.
Figure 7:
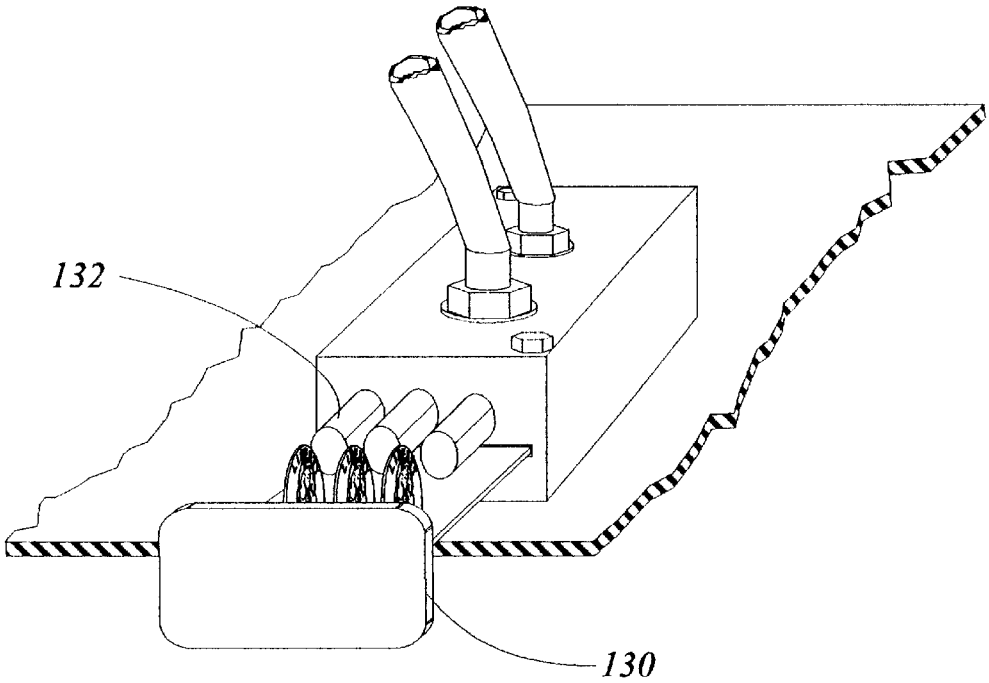
FIG. 7 is a perspective view of the non-electric vending machine of the present invention, in partial section, showing the coin mechanism and activation valve.
Figure 8:
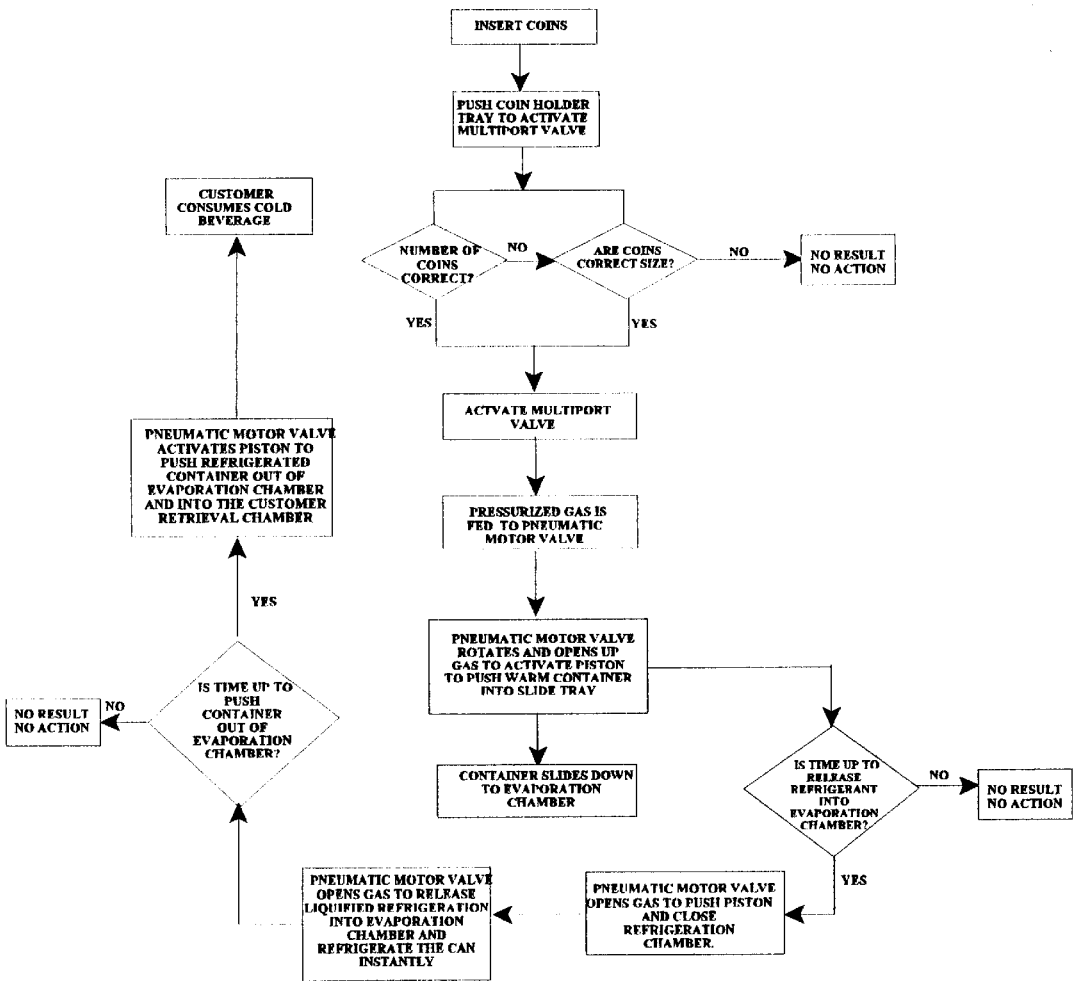
FIG. 8 is a functional block diagram of the non-electric vending machine of the present invention.
Figure 9:
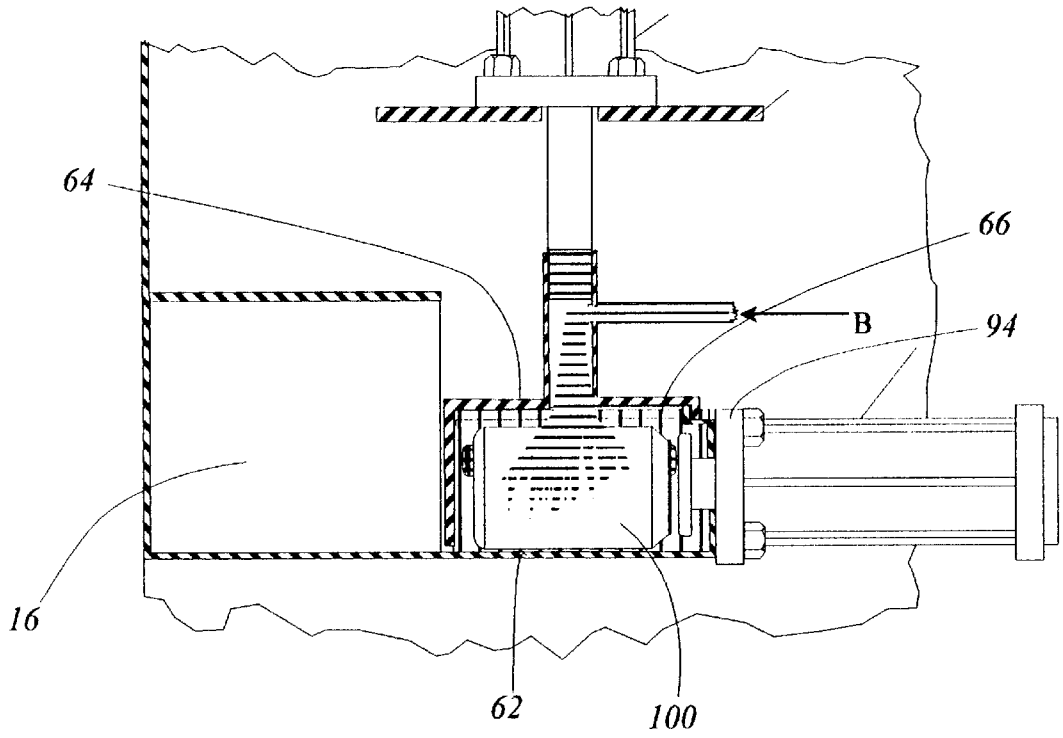
FIG. 9 is a cross sectional view of the cooling chamber and retrieval tray, taken across the line 9—9 of FIG. 4.
Figure 10:
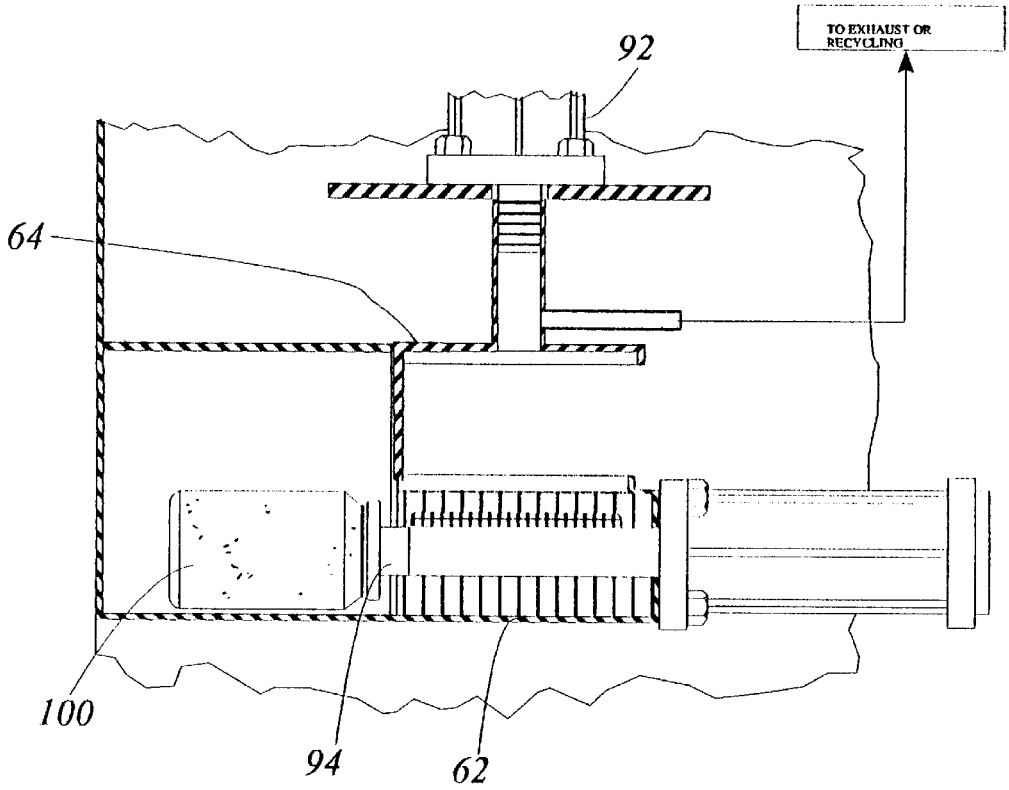
FIG. 10 is a cross sectional view of the cooling chamber and retrieval tray, taken across the line 10—10 of FIG. 5.
Figure 11:
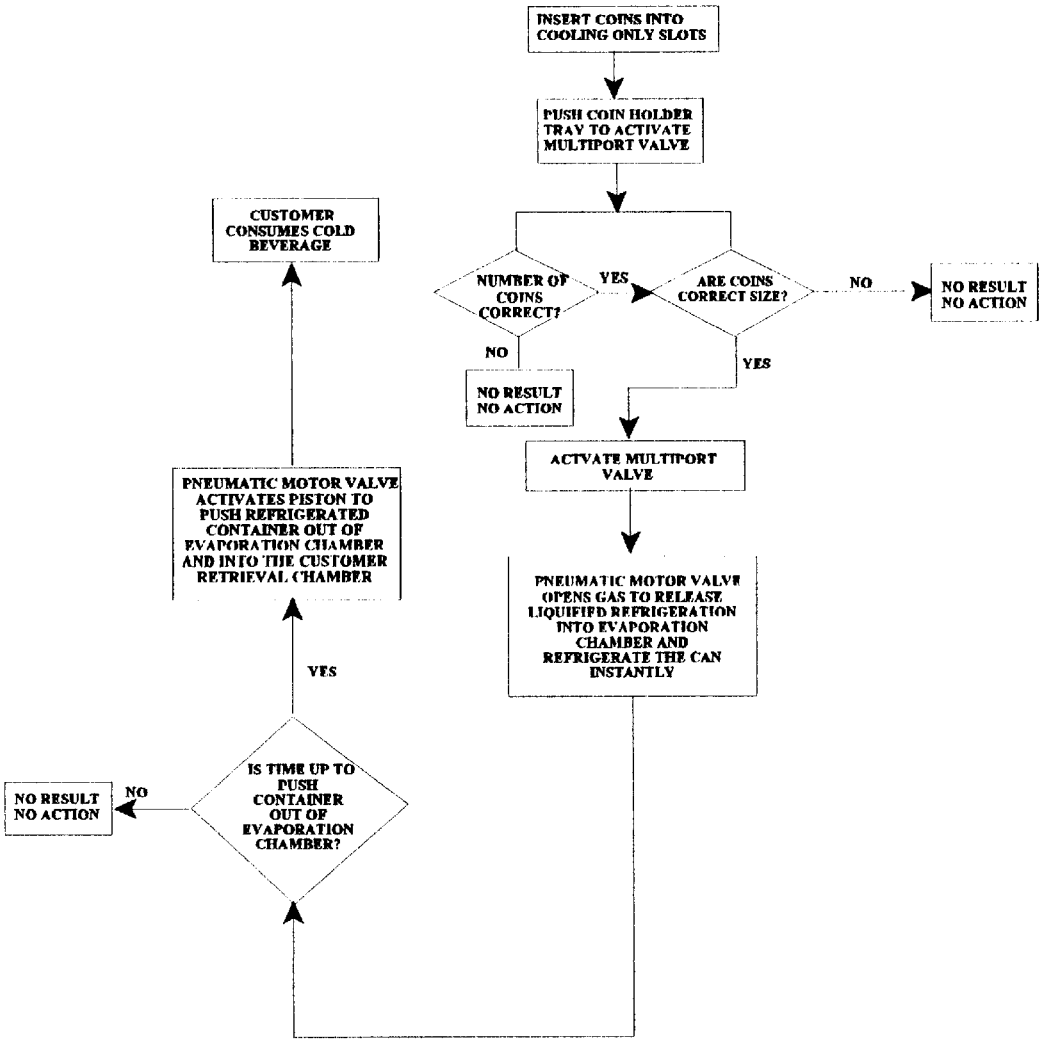
FIG. 11 is a functional block diagram of the non-dispensed item cooling process option of the non-electric vending machine of the present invention.

As shown in FIGS. 1–11 , the present invention is directed towards a new and improved non-electric refrigerating vending machine 10 structured to store a plurality of items to be vended 100 at room temperature and to selectively dispense individual chilled items as selected by a purchaser, without the use of electric power. The machine 10 comprises a main housing 12, which housing is well insulated, tank 20, a storage tray 30, a track 40, a cooling chamber 60, a control valve 80 and three pneumatic pistons 90, 92, 94.

The main housing 12 is a generally rectangular structure similar to those commonly used for vending machines. The main housing is well insulated so that heat transmitted from the environment is limited. The main housing 12 includes an outer surface 14, internally lined with insulation 129, having a retrieval tray 16 and at least one receptacle 18 structured to receive currency from a purchaser integrally formed therein. A key lock 19 or other similar locking means known in the art may also be included to prevent theft of the items to be vended or any other tampering with the machine 10.

The tank 20 is removably secured within the main housing 12 and is filled with a pressurized liquified gas or gas mixture capable of being emitted either as a gas or a refrigerant liquid. Carbon dioxide or nitrogen are examples of two gases which are liquifiable which may be utilized for this purpose. However, any other suitable liquifiable gas mixture may, alternatively, be utilized. For example, a mixture of $CO_2$ and $H_2O$ may be used to provide both gas pressure and super-cooled water and ice to chill the vended ice The tank 20 includes two output valves 22, 24, the first 22 structured to dispense the pressurized gaseous phase of the gas and the second valve 24 structured to dispense the pressurized liquified phase of the gas. A pressure gauge 26 is provided on the outer surface 14 to indicate the internal pressure within the tank 20 so that the operator will know when to refill the tank 20. The tank 20 may be removably secured to the main housing 12 by brackets 28 or any other suitable attachment means known in the art. Alternatively, two tanks may be used, one for the supply of the gaseous phase, another for the liquified refrigerant phase.

In the preferred embodiment, the storage tray 30 includes a generally downwardly sloping bottom surface 32 and surrounding sidewalls 33, 34, 35, 36 and is structured to retain the items to be vended 100. The downwardly sloping bottom surface 32 causes the items to be vended 100 to slide towards the forward most sidewall 33. It must be appreciated that other structures and configurations, such as a vertically disposed stacking type storage compartment, may, alternatively, be used to accomplish the same result as the preferred embodiment described herein.

The track 40 includes a first upper end 42 coupled to one of said sidewalls 34 of the storage tray 30 and a second lower end 44 coupled to the cooling chamber 60. The track 40 is disposed so that it slopes downward from the first upper end 42 to the second lower end 44. The first pneumatic piston 90 is coupled to the control valve 80 and mounted to the sidewall 35 of the storage tray 30 on the opposite side of the storage tray 30 from which the first upper end 42 of the track 40 is coupled. The first piston 90, the storage tray 30 and the track 40 are structured and disposed so that upon application of gas to the first piston 90, the first piston 90 will project through the sidewall 35 and push the forwardmost row of items to be vended 100 towards the opposite sidewall 34 until the selected item to be vended 100 closest to the track 40 is pushed onto the first upper end 42. The selected item to be vended 100 will then slide down said track 40 and into the cooling chamber 60. In the case when multiple storage trays are used, a tray selection valve may be added to allow the consumer to select a storage tray 30 holding the preferred vending item 100. In this case, several pistons 90 may be installed on accompanying storage trays 30 so that a customer may use the said selection valve to select a particular piston 90 for dispensing the preferred vended item 100.

The cooling chamber 60 includes a generally concave-shaped base 62 coupled to the retrieval tray 16 and a correspondingly shaped top 64 structured to mate with the base 62 so that the select item to be vended 100 may be enclosed therein. The second piston 92 is coupled to the control valve 80 and mounted to the top 64. The second piston 92 is structured and disposed to lower the top 64 onto the base 62 after receipt of the select item to be vended 100 into the base 62 and raise the top 64 off of the base 62 after the select item to be vended 100 has been cooled.

The cooling chamber 60 is also coupled to a second control valve 110 in fluid communication thereto so that after the select item to be vended 100 is received into the base 62 and the top 64 is lowered to enclose the select item to be vended 100 therein, the refrigerant liquid is applied to the select item to be vended 100 for a predetermined length of time. The cooling chamber 60 may also include a continuous channel or pathway 66 which is structured to surround the select item to be vended 100 so that the refrigerant liquid will be uniformly cycled around the entire select item to be vended 100, thereby optimizing the cooling process, as the liquified refrigerant evaporates and removes heat from vended item 100.

The third piston 94 is coupled to the control valve 80 and mounted to the sidewall 68 of the cooling chamber 60 opposite the retrieval tray 16. The third piston 94, cooling chamber 60 and retrieval tray 16 are structured and disposed so that upon application of gas to the third piston 94, the third piston 94 will project through the sidewall 68 of the cooling chamber 60, thereby pushing the select item to be vended 100 out of the cooling chamber 60 and into the retrieval tray 16.

Although the preferred embodiment describes pneumatic style pistons, it must be appreciated that hydraulic and other suitable style pistons known in the art may, alternatively, be used.

The control valve 80 is a multiple output rotary indexing valve or timing valve of the type well known in the art. The valve 80 includes an input port 82 structured to receive gas from the tank 20. The valve 80 is structured to rotate through a single cycle each time gas is received in the input port 82 so that the gas is selectively directed to the appropriate piston 90, 92, 94 and valve 110 at a predetermined time and for a predetermined length of time, thereby controlling the sequence of operation of the machine 10.

Upon receipt of the gas, the valve 80 begins to rotate and first triggers the output port 84 coupled to the first piston 90, sending gas to the first piston 90 and causing the first piston 90 to project through the sidewall 35 of the storage tray and push the select item to be vended 100 onto the track 40. The valve 80 next triggers the output port 85 coupled to the second piston 92, sending gas to the second piston 92 and causing the second piston 92 to lower the top 64 onto the base 62, thereby enclosing the select item to be vended 100 therein. The valve 80 next triggers the output port 86 coupled to a second timing valve 110. The second timing valve 110 is coupled to the tank 20 in fluid communication thereto so that upon receipt of gas from control valve 80, timing valve 110 will likewise begin to rotate and dispense the cooling liquid to the cooling chamber 60 for a predetermined length of time, during which evaporation of said liquified refrigerant removes heat from vended item 100. The valve 80 next triggers the output port 87 coupled to the third piston 94, sending gas to the third piston 94 and causing the third piston 94 to project through the sidewall 68 of the cooling chamber 60, thereby pushing the select item to be vended 100 out of the cooling chamber 60 and into the retrieval tray 16, where it may be retrieved by the purchaser. Check valves 112 are provided on each gas and refrigerant line to prevent the backflow of such gas or refrigerant back into the appropriate valve.

The control valve 80 and timing valve 110 are structured so that sufficient time is provided to complete each step of the process before the subsequent step is initiated. For instance, gas will not be applied to the third piston 94 until the application of the refrigerant liquid to the cooling chamber 60 is completed, with said refrigerant liquid flashing around the surface of the vended item within cooling chamber 60, thereby removing heat from vended item 100, and evaporating into a gaseous phase and said gaseous phase exhausted through exhaust manifold X to atmosphere.

Although the preferred embodiment accomplishes the control and sequencing with control valve 80 and timing valve 110, it should be appreciated that such control and sequencing may, alternatively, be accomplished by one or more valves. Additionally, the types of valves utilized may vary.

A first coin tray 130 is provided on the outer surface 114 of the main housing 112. The coin tray 130 is structured to receive a predetermined number of coins of certain denominations so that upon insertion of the coin tray 130 into the main housing 112, the activation circuit 132 is closed, thereby allowing the gas from the tank to flow to the control valve 80 and the sequence of operation to be initiated. Other currency receptacles known in the art may, alternatively, be used. Additionally, means for selecting the desired item to be vended may also be employed.

In a second preferred embodiment, a user may insert their own item to be refrigerated into the retrieval tray 16 and slide such item into the cooling chamber 60. A second coin tray 140 and third timing valve 142 are provided so that upon receipt of the proper coins, gas is applied to the second 110 and third timing valves 142 initiating the following sequence of operation:

1. gas from the tank is sent to the second piston 92 causing the top 64 to close over the item to be refrigerated;
2. refrigerant liquid is sent to the cooling chamber 60 for a predetermined length of time; during which said refrigerant liquid absorbs heat from the vended item 100 and evaporates, cooling the vended item 100; and
3. gas is sent to the third piston 94 causing the third piston 94 to project through the sidewall 68 of the cooling chamber 60, thereby pushing the item to be refrigerated out of the cooling chamber 60 and into the retrieval tray 16 where it may be retrieved by the user.

As with the first preferred embodiment, the number of valves employed in the second preferred embodiment to accomplish the control and sequencing may vary.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A non-electric refrigerating vending machine comprising:

a main housing having an outer surface and an insulated internal surface with a retrieval tray integrally formed therein;

storage means for storing a plurality of items to be vended;

a tank having pressurized refrigerant gas therein in both liquid and gaseous phases and structured to selectively dispense a gas and a refrigerant liquid;

a cooling chamber structured to receive a select one of said plurality of items to be vended therein;

first transporting means for transporting said select one of said plurality of items to be vended from said storage means to said cooling chamber;

second transporting means for transporting said select one of said plurality of items to be vended from said cooling chamber to said retrieval tray;

means for controlling the sequence of operation so that said select one of said plurality of items to be vended is transported from said storage means to said cooling chamber, subjected to said cooling liquid for a predetermined period of time and then transported to said retrieval tray; and activation means for activating the means for controlling the sequence of operation and selecting said select one of said plurality of items to be vended, said activation means being disposed on said outer surface of said main housing.

2. A non-electric refrigerating vending machine as recited in claim 1 wherein said means for controlling the sequence of operation comprises at least one timing valve coupled to said tank, said first transporting means, said cooling chamber and said second transporting means, said at least one timing valve being structured to selectively dispense said gas to said first transporting means, said cooling chamber and said second transporting means and said refrigerant liquid to said cooling chamber.

3. A non-electric refrigerating vending machine as recited in claim 1 wherein said storage means comprises one or more generally downwardly sloping tray having a bottom surface and surrounding sidewalls.

4. A non-electric refrigerating vending machine as recited in claim 3 wherein said first transporting means comprises a downwardly sloping track and a first piston, said track having a first upper end coupled to one of said sidewalls of said tray and a second lower end coupled to said cooling chamber, said first piston being mounted to an opposite one of said sidewalls of said tray and coupled to said means for controlling the sequence of operation so that when operable, said gas is applied to said first piston causing said first piston to push said select one of said plurality of items to be vended onto said first upper end of said track and said select one of said plurality of items to be vended to slide down said track and into said cooling chamber.

5. A non-electric refrigerating vending machine as recited in claim 1 wherein said cooling chamber comprises a generally concave-shaped base mounted adjacent said retrieval tray and a correspondingly shaped top structured to mate with said base so that said select one of said plurality of items to be vended may be enclosed therein, said cooling chamber further including a second piston structured to lower and raise said top from said base, said second piston being coupled to said means for controlling the sequence of operation so that when operable, said gas is applied to said second piston causing said second piston to lower said top onto said base.

6. A non-electric refrigerating vending machine as recited in claim 5 wherein said second transporting means comprises a third piston mounted to a sidewall of said cooling chamber opposite said retrieval tray, said third piston being coupled to said means for controlling the sequence of operation so that when operable, said gas is applied to said third piston causing said third piston to push said select one of said plurality of items to be vended from said cooling chamber to said retrieval tray.

7. A non-electric refrigerating vending machine as recited in claim 1 wherein said activation means comprises at least one currency receptacle coupled to said means for controlling the sequence of operation, said currency receptacle being structured to initiate operation of said means for controlling the sequence of operation upon receipt of a predetermined amount of currency.

8. A non-electric refrigerating vending machine as recited in claim 1 further comprising a gauge for measuring said gas pressure within said tank.

9. A non-electric refrigerating vending machine comprising:

a main housing having an outer surface and an internal insulated surface with a retrieval tray integrally formed therein;

storage means for storing a plurality of items to be vended;

a tank having pressurized gas in the liquid and gaseous phases therein and structured to selectively dispense a gas and a refrigerant liquid;

a cooling chamber structured to receive a select one of said plurality of items to be vended therein;

first transporting means for transporting said select one of said plurality of items to be vended from said storage means to said cooling chamber;

second transporting means for transporting said select one of said plurality of items to be vended from said cooling chamber to said retrieval tray;

at least one timing valve coupled to said tank, said first transporting means, said cooling chamber and said second transporting means, said at least one timing valve being structured to control the sequence of operation and selectively dispense said gas to said first transporting means, said cooling chamber and said second transporting means and said refrigerant liquid to said cooling chamber so that said select one of said plurality of items to be vended is transported from said storage means to said cooling chamber, subjected to said refrigerant liquid for a predetermined period of time and then transported to said retrieval tray; and activation means for activating the means for controlling the sequence of operation and selecting said select one of said plurality of items to be vended, said activation means being disposed on said outer surface of said main housing.

10. A non-electric refrigerating vending machine as recited in claim 9 wherein said storage means comprises one or more generally downwardly sloping trays having a bottom surface and surrounding sidewalls.

11. A non-electric refrigerating vending machine as recited in claim 10 wherein said first transporting means comprises a downwardly sloping track and a first piston, said track having a first upper end coupled to one of said sidewalls of said tray and a second lower end coupled to said cooling chamber, said first piston being mounted to an opposite one of said sidewalls of said tray and coupled to said means for controlling the sequence of operation so that when operable, said gas is applied to said first piston causing said first piston to push said select one of said plurality of items to be vended onto said first upper end of said track and said select one of said plurality of items to be vended to slide down said track and into said cooling chamber.

12. A non-electric refrigerating vending machine as recited in claim 9 wherein said cooling chamber comprises a generally concave-shaped base mounted adjacent said retrieval tray and a correspondingly shaped top structured to mate with said base so that said select one of said plurality of items to be vended may be enclosed therein, said cooling chamber further including a second piston structured to lower and raise said top from said base, said second piston being coupled to said means for controlling the sequence of operation so that when operable, said gas is applied to said second piston causing said second piston to lower said top onto said base.

13. A non-electric refrigerating vending machine as recited in claim 12 wherein said second transporting means comprises a third piston mounted to a sidewall of said cooling chamber opposite said retrieval tray, said third piston being coupled to said means for controlling the sequence of operation so that when operable, said gas is applied to said third piston causing said third piston to push said select one of said plurality of items to be vended from said cooling chamber to said retrieval tray.

14. A non-electric refrigerating vending machine as recited in claim 9 wherein said activation means comprises at least one currency receptacle coupled to said means for controlling the sequence of operation, said currency receptacle being structured to initiate operation of said means for controlling the sequence of operation upon receipt of a predetermined amount of currency.

15. A non-electric refrigerating vending machine as recited in claim 9 further comprising gauge for measuring said gas pressure within said tank.

16. A non-electric refrigerating vending machine comprising:

a main housing having an outer surface and an internal insulated surface, with a retrieval tray integrally formed therein;

storage means for storing a plurality of items to be vended;

a tank having pressurized gas therein and structured to selectively dispense a gas and a refrigerant liquid;

a cooling chamber structured to receive a select one of said plurality of items to be vended therein, said cooling chamber comprising a generally concave-shaped base mounted adjacent said retrieval tray and a correspondingly shaped top structured to mate with said base so that said select one of said plurality of items to be vended may be enclosed therein, said cooling chamber further comprising a second piston structured to lower and raise said top from said base;

first transporting means for transporting said select one of said plurality of items to be vended from said storage means to said cooling chamber;

second transporting means for transporting said select one of said plurality of items to be vended from said cooling chamber to said retrieval tray, said second transporting means comprising a third piston mounted to a sidewall of said cooling chamber opposite said retrieval tray;

at least one timing valve coupled to said tank, said first transporting means, said cooling chamber and said second transporting means, said at least one timing valve being structured to control the sequence of operation and selectively dispense said gas to said first transporting means, said second piston and said third piston and said refrigerant liquid to said cooling chamber so that said select one of said plurality of items to be vended is transported from said storage means to said cooling chamber and enclosed therein, subjected to said refrigerant liquid for a predetermined period of time and then transported to said retrieval tray; and activation means for activating the means for controlling the sequence of operation and selecting said select one of said plurality of items to be vended, said activation means being disposed on said outer surface of said main housing.

17. A non-electric refrigerating vending machine as recited in claim 16 wherein said storage means comprises a generally downwardly sloping tray having a bottom surface and surrounding sidewalls.

18. A non-electric refrigerating vending machine as recited in claim 17 wherein said first transporting means comprises a downwardly sloping track and a first piston, said track having a first upper end coupled to one of said sidewalls of said tray and a second lower end coupled to said cooling chamber, said first piston being mounted to an opposite one of said sidewalls of said tray and coupled to said means for controlling the sequence of operation so that when operable, said gas is applied to said first piston causing said first piston to push said select one of said plurality of items to be vended onto said first upper end of said track and said select one of said plurality of items to be vended to slide down said track and into said cooling chamber.

19. A non-electric refrigerating vending machine as recited in claim 16 wherein said activation means comprises at least one currency receptacle coupled to said means for controlling the sequence of operation, said currency receptacle being structured to initiate operation of said means for controlling the sequence of operation upon receipt of a predetermined amount of currency.

20. A non-electric refrigerating vending machine as recited in claim 16 further comprising a gauge for measuring said gas pressure within said tank.

* * * * *